US006226607B1

(12) United States Patent
Chang et al.

(10) Patent No.: US 6,226,607 B1
(45) Date of Patent: May 1, 2001

(54) METHOD AND APPARATUS FOR EIGHTH-RATE RANDOM NUMBER GENERATION FOR SPEECH CODERS

(75) Inventors: Chienchung Chang; Toa Shen, both of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/248,516

(22) Filed: Feb. 8, 1999

(51) Int. Cl.[7] ..... G10L 19/12

(52) U.S. Cl. ..... 704/221; 704/210; 704/215; 704/230; 704/229; 704/240

(58) Field of Search ..... 704/221, 210, 704/230, 240, 215, 233, 219, 222, 223, 206, 236, 214

(56) References Cited

U.S. PATENT DOCUMENTS

| | | | | |
|---|---|---|---|---|
| 5,307,441 | * | 4/1994 | Tzeng | 704/222 |
| 5,414,796 | | 5/1995 | Jacobs et al. | 395/2.3 |
| 5,657,420 | | 8/1997 | Jacobs et al. . | |
| 5,778,338 | * | 7/1998 | Jacobs et al. | 704/223 |
| 5,911,128 | * | 6/1999 | DeJaco | 704/221 |
| 5,974,375 | | 10/1999 | Aoyagi et al. . | |
| 6,041,297 | * | 3/2000 | Goldberg | 704/219 |

FOREIGN PATENT DOCUMENTS 0786760 7/1997 (EP) .

OTHER PUBLICATIONS

1978 Digital Processing of Speech Signals, "Linear Predictive Coding of Speech", L.R. Rabiner et al., pp. 396–453.

* cited by examiner

*Primary Examiner*—William R. Korzuch
*Assistant Examiner*—Vijay B Chawan
(74) *Attorney, Agent, or Firm*—Philip R. Wadsworth; Thomas R. Rouse

(57) ABSTRACT

A method and apparatus for eighth-rate random number generation for speech coders includes a random number generator configured to generate values of a first random variable. A lookup table is used to store values of a second random variable. The lookup table is addressed with the values of the first random variable. The second random variable is an inverse transform of a cumulative distribution function of the first random variable. An codec encodes input silence frames with the values of the first and second random variables, and regenerates the silence frames with the values of the first and second random variables. The speech coder may be an enhanced variable rate coder, and the silence frames may be encoded at eighth rate. The random variables are advantageously Gaussian random variables with values that are uniformly distributed between zero and one.

14 Claims, 6 Drawing Sheets

GAUSSIAN DATA:

Q15 INTEGER

| | | | | | | |
|---|---|---|---|---|---|---|
| -21763, | -19792, | -18561, | -17657, | -16918, | -16261, | -15686, |
| -15276, | -14782, | -14454, | -14044, | -13715, | -13387, | -13140, |
| -12811, | -12565, | -12319, | -12073, | -11826, | -11579, | -11416, |
| -11169, | -11005, | -10759, | -10594, | -10430, | -10265, | -10102, |
| -9855, | -9691, | -9526, | -9445, | -9280, | -9116, | -8951, |
| -8788, | -8706, | -8541, | -8377, | -8294, | -8131, | -7966, |
| -7884, | -7720, | -7637, | -7474, | -7392, | -7227, | -7145, |
| -6980, | -6898, | -6817, | -6652, | -6570, | -6488, | -6323, |
| -6241, | -6160, | -5995, | -5913, | -5831, | -5749, | -5584, |
| -5503, | -5421, | -5338, | -5174, | -5092, | -5009, | -4927, |
| -4846, | -4764, | -4599, | -4517, | -4435, | -4352, | -4270, |
| -4189, | -4107, | -4024, | -3860, | -3778, | -3695, | -3613, |
| -3532, | -3450, | -3367, | -3285, | -3203, | -3121, | -3038, |
| -2956, | -2875, | -2793, | -2710, | -2628, | -2546, | -2381, |
| -2299, | -2218, | -2136, | -2053, | -1971, | -1889, | -1807, |
| -1724, | -1642, | -1561, | -1479, | -1396, | -1314, | -1232, |
| -1150, | -1067, | -985, | -904, | -822, | -739, | -657, |
| -575, | -493, | -410, | -328, | -247, | -165, | -82 |
| 0, | 0 | | | | | |

FLOATING:

| | | | | | | |
|---|---|---|---|---|---|---|
| -0.6642 | -0.6040 | -0.5664 | -0.5388 | -0.5163 | -0.4962 | -0.4787 |
| -0.4662 | -0.4511 | -0.4411 | -0.4286 | -0.4185 | -0.4085 | -0.4010 |
| -0.3910 | -0.3835 | -0.3759 | -0.3684 | -0.3609 | -0.3534 | -0.3484 |
| -0.3409 | -0.3358 | -0.3283 | -0.3233 | -0.3183 | -0.3133 | -0.3083 |
| -0.3008 | -0.2957 | -0.2907 | -0.2882 | -0.2832 | -0.2782 | -0.2732 |
| -0.2682 | -0.2657 | -0.2607 | -0.2556 | -0.2531 | -0.2481 | -0.2431 |
| -0.2406 | -0.2356 | -0.2331 | -0.2281 | -0.2256 | -0.2206 | -0.2180 |
| -0.2130 | -0.2105 | -0.2080 | -0.2030 | -0.2005 | -0.1980 | -0.1930 |
| -0.1905 | -0.1880 | -0.1830 | -0.1805 | -0.1779 | -0.1754 | -0.1704 |
| -0.1679 | -0.1654 | -0.1629 | -0.1579 | -0.1554 | -0.1529 | -0.1504 |
| -0.1479 | -0.1454 | -0.1404 | -0.1378 | -0.1353 | -0.1328 | -0.1303 |
| -0.1278 | -0.1253 | -0.1228 | -0.1178 | -0.1153 | -0.1128 | -0.1103 |
| -0.1078 | -0.1053 | -0.1028 | -0.1003 | -0.0977 | -0.0952 | -0.0927 |
| -0.0902 | -0.0877 | -0.0852 | -0.0827 | -0.0802 | -0.0777 | -0.0727 |
| -0.0702 | -0.0677 | -0.0652 | -0.0627 | -0.0602 | -0.0576 | -0.0551 |
| -0.0526 | -0.0501 | -0.0476 | -0.0451 | -0.0426 | -0.0401 | -0.0376 |
| -0.0351 | -0.0326 | -0.0301 | -0.0276 | -0.0251 | -0.0226 | -0.0201 |
| -0.0175 | -0.0150 | -0.0125 | -0.0100 | -0.0075 | -0.0050 | -0.0025 |
| 0 | 0 | | | | | |

FIG. 7

METHOD AND APPARATUS FOR EIGHTH-RATE RANDOM NUMBER GENERATION FOR SPEECH CODERS

BACKGROUND OF THE INVENTION

1. Field of the Invention

The present invention pertains generally to the field of speech processing, and more specifically to a method and apparatus for eighth-rate random number generation for speech coders.

2. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and then resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

A well-known speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding of the LP short-term filter coefficients and encoding the LP residue. An exemplary variable rate CELP coder is described in U.S. Pat. No. 5,414,796, which is assigned to the assignee of the present invention and fully incorporated herein by reference.

In conventional speech coders, nonspeech or silence is often encoded at eighth rate (as opposed to full rate, half rate, or quarter rate in a variable rate speech coder) instead of simply not being encoded. To encode the silence at eighth rate, the energy of the current speech frame is measured, quantized, and transmitted to the decoder. A comfort noise (to the listener) with equivalent energy is then reproduced in the decoder side. The noise is usually modeled as white Gaussian noise. There are several methods to generate Gaussian random noise in a digital signal processor (DSP), including, e.g., using the central limit theorem with two statistically independent, identically distributed random variables with uniform probability distribution. However, intensive computation must be performed, including nonlinear, mathematical operations or transformations such as calculating the square roots of the random variables, the cosine and sine transformations, logarithmic functions, etc. Such operations require high memory capacity and are extremely computation-intensive. For example, computing the sine and cosine of a function requires calculating a Taylor series expansion of the function. Thus, there is a need for an encoding and decoding method that reduces memory needs and computational requirements.

SUMMARY OF THE INVENTION

The present invention is directed to an encoding and decoding method that reduces memory needs and computational requirements. Accordingly, in one aspect of the invention, a speech coder advantageously includes a random number generator configured to generate values of a first random variable; a storage medium coupled to the random number generator, the storage medium containing values of a second random variable, the second random variable comprising an inverse transform of a cumulative distribution function of the first random variable; and a codec coupled to the random number generator, the codec being configured to encode input silence frames with the values of the first and second random variables and to regenerate the silence frames with the values of the first and second random variables.

In another aspect of the invention, a method of encoding silence frames advantageously includes the steps of generating values of a first random variable; storing values of a second random variable, the second random variable comprising an inverse transform of a cumulative distribution function of the first random variable; encoding silence frames with the values of the first and second random variables; and regenerating the silence frames with the values of the first and second random variables.

In another aspect of the invention, a speech coder advantageously includes means for generating values of a first random variable; means for storing values of a second random variable, the second random variable comprising an inverse transform of a cumulative distribution function of the first random variable; and means for encoding silence frames with the values of the first and second random variables; and means for regenerating the silence frames with the values of the first and second random variables.

BRIEF DESCRIPTION OF THE DRAWINGS

FIG. 7 is a table of Gaussian data for a lookup table.

DETAILED DESCRIPTION OF THE PREFERRED EMBODIMENTS

Figure 1:
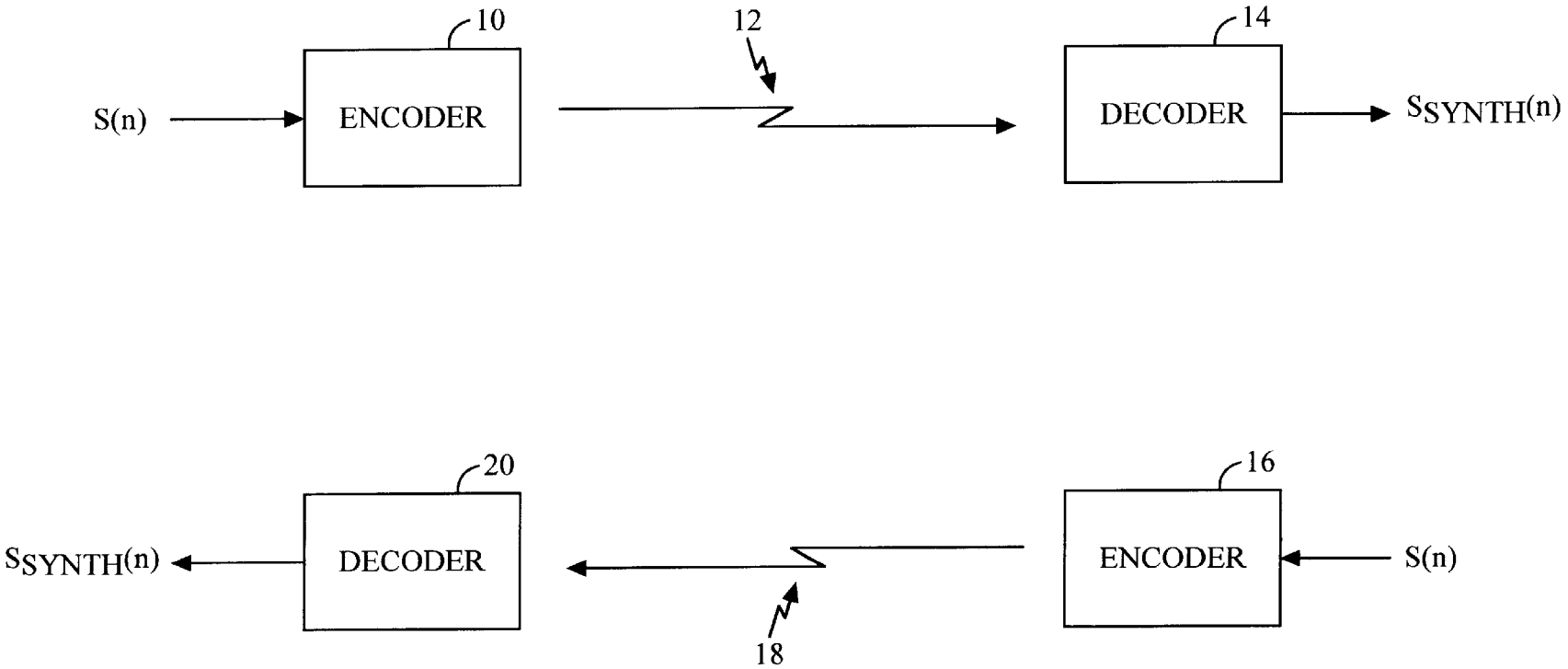
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532, entitled VOCODER ASIC, issued Jul. 28, 1998, assigned to the assignee of the present invention, and fully incorporated herein by reference.

Figure 2:
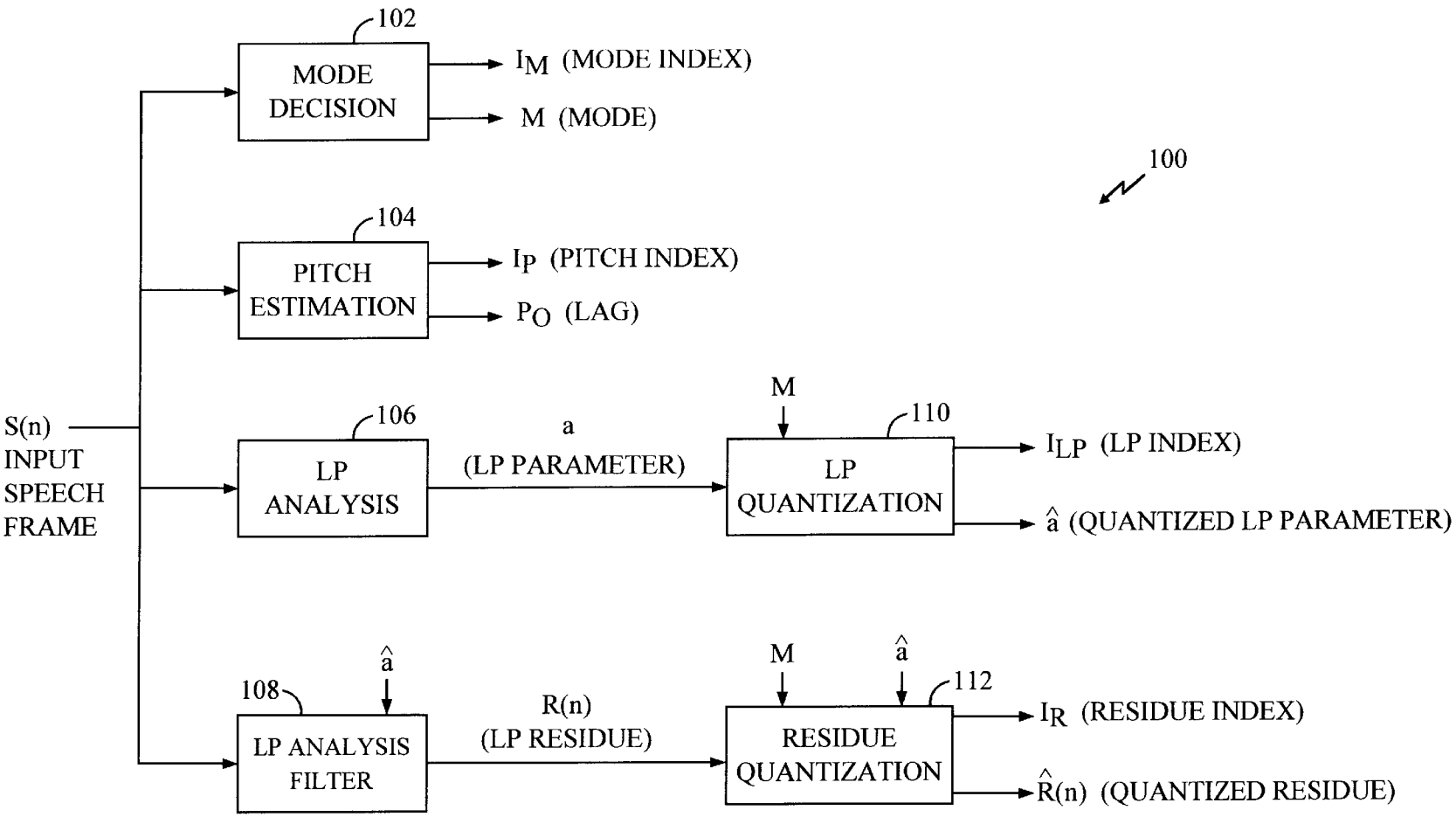
FIG. 2 is a block diagram of an encoder.

In FIG. 2 an encoder 100 that may be used in a speech coder includes a mode decision module 102, a pitch estimation module 104, an LP analysis module 106, an LP analysis filter 108, an LP quantization module 110, and a residue quantization module 112. Input speech frames s(n) are provided to the mode decision module 102, the pitch estimation module 104, the LP analysis module 106, and the LP analysis filter 108. The mode decision module 102 produces a mode index $I_M$ and a mode M based upon the periodicity of each input speech frame s(n). Various methods of classifying speech frames according to periodicity are described in U.S. Pat. No. 5,911,128, entitled METHOD AND APPARATUS FOR PERFORMING REDUCED RATE VARIABLE RATE VOCODING, issued Jun. 8, 1999, assigned to the assignee of the present invention, and fully incorporated herein by reference. Such methods are also incorporated into the Telecommunication Industry Association Industry Interim Standards TIA/EIA IS-127 and TIA/EIA IS-733.

The pitch estimation module 104 produces a pitch index $I_P$ and a lag value $P_O$ based upon each input speech frame s(n). The LP analysis module 106 performs linear predictive analysis on each input speech frame s(n) to generate an LP parameter $\alpha$. The LP parameter $\alpha$ is provided to the LP quantization module 110. The LP quantization module 110 also receives the mode M. The LP quantization module 110 produces an LP index $I_{LP}$ and a quantized LP parameter $\hat{\alpha}$. The LP analysis filter 108 receives the quantized LP parameter $\hat{\alpha}$ in addition to the input speech frame s(n). The LP analysis filter 108 generates an LP residue signal R[n], which represents the error between the input speech frames s(n) and the reconstructed speech based on the quantized linear predicted parameters $\hat{\alpha}$. The LP residue R[n], the mode M, and the quantized LP parameter $\hat{\alpha}$ are provided to the residue quantization module 112. Based upon these values, the residue quantization module 112 produces a residue index $I_R$ and a quantized residue signal $\hat{R}[n]$.

Figure 3:
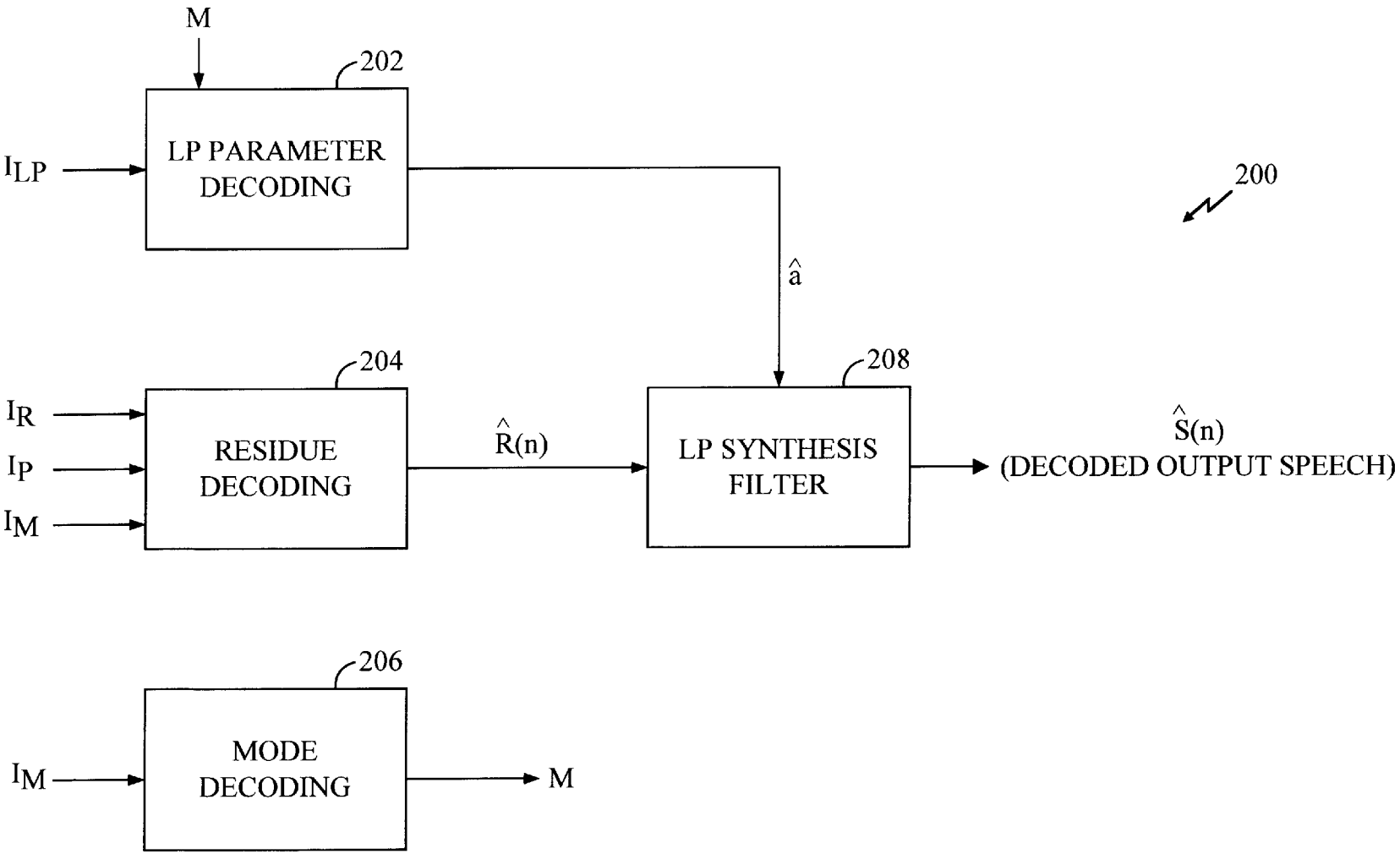
FIG. 3 is a block diagram of a decoder.

In FIG. 3 a decoder 200 that may be used in a speech coder includes an LP parameter decoding module 202, a residue decoding module 204, a mode decoding module 206, and an LP synthesis filter 208. The mode decoding module 206 receives and decodes a mode index $I_M$, generating therefrom a mode M. The LP parameter decoding module 202 receives the mode M and an LP index $I_{LP}$. The LP parameter decoding module 202 decodes the received values to produce a quantized LP parameter $\hat{\alpha}$. The residue decoding module 204 receives a residue index $I_R$, a pitch index $I_P$, and the mode index $I_M$. The residue decoding module 204 decodes the received values to generate a quantized residue signal $\hat{R}[n]$. The quantized residue signal $\hat{R}[n]$ and the quantized LP parameter $\hat{\alpha}$ are provided to the LP synthesis filter 208, which synthesizes a decoded output speech signal $\hat{s}[n]$ therefrom.

Operation and implementation of the various modules of the encoder 100 of FIG. 2 and the decoder 200 of FIG. 3 are known in the art and described in the aforementioned U.S. Pat. No. 5,414,796 and L. B. Rabiner & R. W. Schafer, *Digital Processing of Speech Signals* 396–453 (1978).

Figure 4:
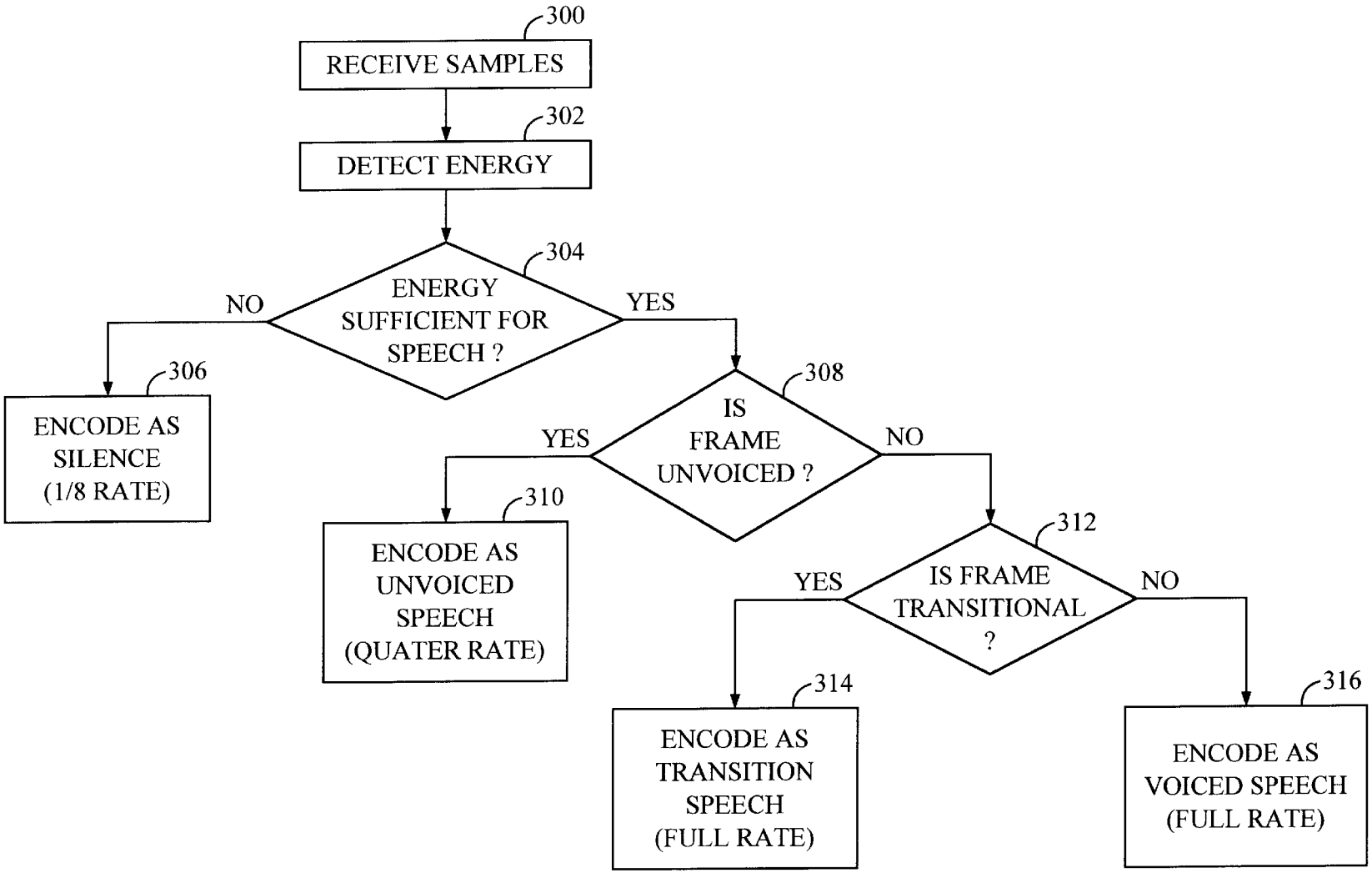
FIG. 4 is a flow chart illustrating a speech coding decision process.

As illustrated in the flow chart of FIG. 4, a speech coder in accordance with one embodiment follows a set of steps in processing speech samples for transmission. The speech coder (not shown) may be an 8 kilobit-per-second (kbps) code excited linear predictive (CELP) coder or a 13 kbps CELP coder, such as the variable rate vocoder described in the aforementioned U.S. Pat. No. 5,414,796. In the alternative, the speech coder may be a code division multiple access (CDMA) enhanced variable rate coder (EVRC).

In step 300 the speech coder receives digital samples of a speech signal in successive frames. Upon receiving a given frame, the speech coder proceeds to step 302. In step 302 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 304. In step 304 the speech coder determines whether the detected frame energy is sufficient to classify the frame as containing speech information. If the detected frame energy falls below a predefined threshold level, the speech coder proceeds to step 306. In step 306 the speech coder encodes the frame as background noise (i.e., nonspeech, or silence). In one embodiment the background noise frame is encoded at ⅛ rate, or 1 kbps. If in step 304 the detected frame energy meets or exceeds the predefined threshold level, the frame is classified as speech and the speech coder proceeds to step 308.

In step 308 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in U.S. Pat. No. 5,911,128, entitled METHOD AND APPARATUS FOR PERFORMING REDUCED RATE VARIABLE RATE VOCODING, issued Jun. 8, 1999, assigned to the assignee of the present invention, and fully incorporated herein by reference. In addition, the above methods used to distinguish voiced speech from unvoiced speech are incorporated into the Telecommunication Industry Association Industry Interim Standards TIA/EIA IS-127 and TIA/EIA IS-733. If the frame is determined to be unvoiced speech in step 308, the speech coder proceeds to step 310. In step 310 the speech coder encodes the frame as unvoiced speech. In one embodiment unvoiced speech frames are encoded at quarter rate, or 2.6 kbps. If in step 308 the frame is not determined to be unvoiced speech, the speech coder proceeds to step 312.

In step 312 the speech coder determines whether the frame is transitional speech, using periodicity detection methods that are known in the art, as described in, e.g., the aforementioned U.S. Pat. No. 5,911,128. If the frame is determined to be transitional speech, the speech coder proceeds to step 314. In step 314 the frame is encoded as transition speech (i.e., transition from unvoiced speech to voiced speech). In one embodiment the transition speech frame is encoded at full rate, or 13.2 kbps.

If in step 312 the speech coder determines that the frame is not transitional speech, the speech coder proceeds to step 316. In step 316 the speech coder encodes the frame as voiced speech. In one embodiment voiced frames may be encoded at full rate, or 13.2 kbps.

In one embodiment the speech coder uses a lookup table (LUT) (not shown) in step 306 to encode frames of silence at ⅛ rate. Exemplary data for an LUT in accordance with a specific embodiment is illustrated in tabular form in FIG. 7. The LUT may advantageously be implemented with ROM memory, but may instead be a storage medium implemented with any conventional form of nonvolatile memory. A Gaussian random variable having a mean of zero and a variance of one is advantageously generated to encode the silence frames. In a specific embodiment, the speech coder is implemented as part of a digital signal processor. Firmware instructions are used by the speech coder to generate the random variable and to access the LUT. In alternate embodiments a software module contained in RAM memory could be used to generate the random variable and to access the LUT. Alternatively, the random variable could be generated with discrete hardware components such as registers and FIFO.

Figure 5:
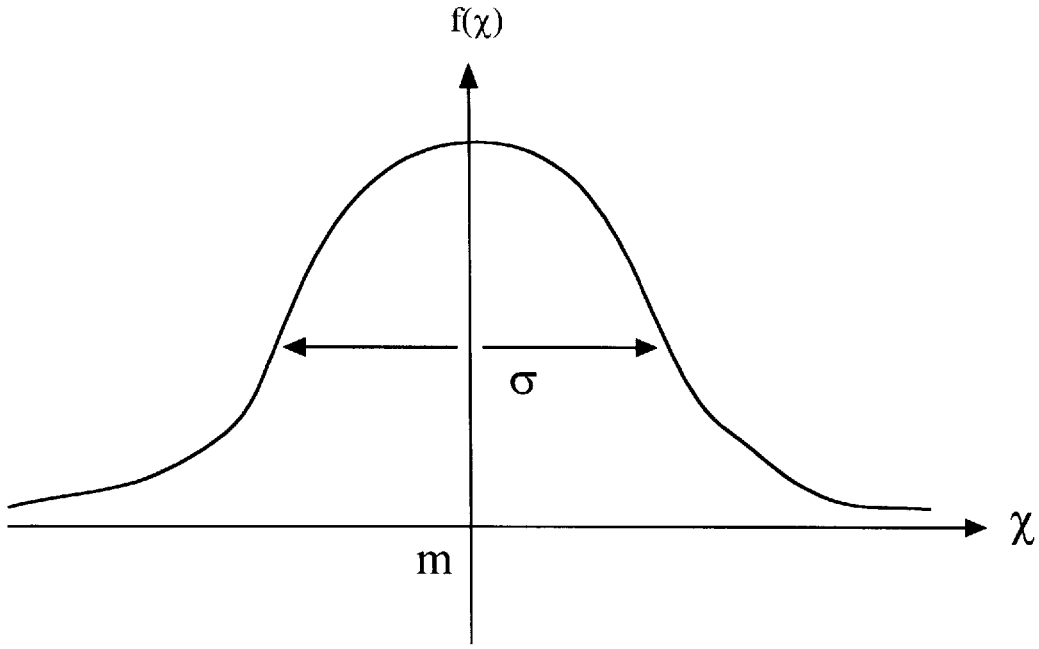
FIG. 5 is a graph of a probability density function of a random variable versus the random variable.

As shown in FIG. 5, a probability density function (pdf) $f_x(x)$ of a Gaussian random variable X is a bell-shaped curve centered around the mean m having standard deviation $\sigma$ and variance $\sigma^2$. The Gaussian pdf $f_x(x)$ satisfies the following equation.

$$f_x(x) = \frac{1}{\sqrt{2\pi\sigma^2}} e^{-\frac{(x-m)^2}{2\sigma^2}}$$

The cumulative distribution function (cdf) $F_x(x)$ is defined as the probability that the random variable X is less than or equal to a particular value X at a given time. Hence, $$F_x(x) = P(X \le X) = \int_{-\infty}^{x} \frac{1}{\sqrt{2\pi\sigma^2}} e^{-\frac{s^2}{2\sigma}} ds$$

Figure 6:
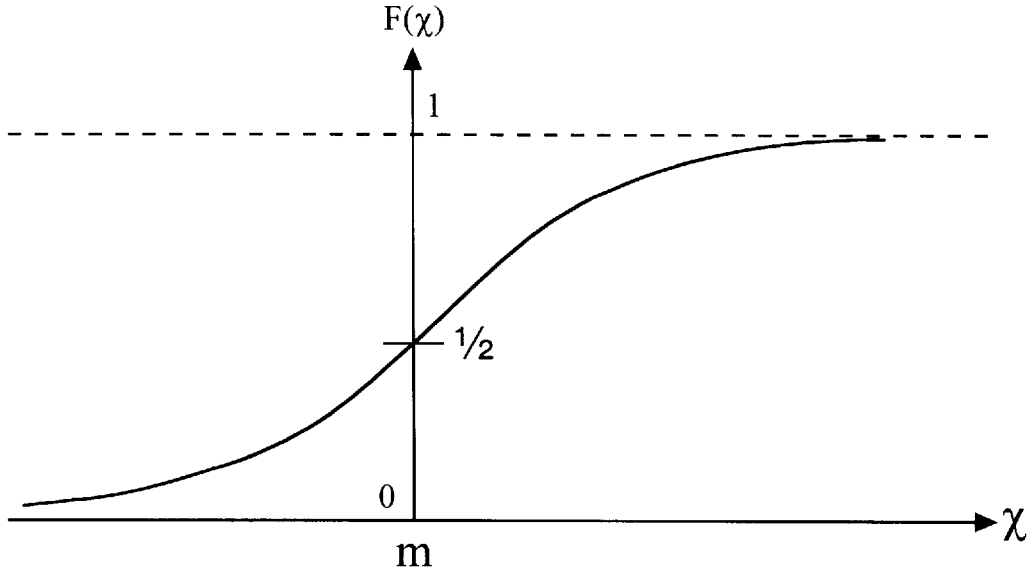
FIG. 6 is a graph of a cumulative distribution function of a random variable versus the random variable.

As shown in FIG. 6, the cdf $F_x(x)$ approaches one as the random variable x approaches infinity, and approaches zero as x approaches negative infinity. A second random variable, Y, which is equal to $F_x(X)$, is a random variable that is uniformly distributed between zero and one regardless of the distribution of X, provided X is a Gaussian random variable with zero mean and variance of one. Taking the inverse transformation of Y yields $X=F^{-1}(Y)$.

In conventional speech coders, a pair of statistically independent, Gaussian functions U and V, each having a mean of zero and a variance of one, are calculated from a pair of statistically independent random variables W and Z in accordance with the following equations:

$$U = \sqrt{-2\ln W}\cos 2\pi Z$$

$$V = \sqrt{-2\ln W}\sin 2\pi Z$$

The random variables W and Z are statistically independent, identically distributed, and uniformly distributed between zero and one. However, the above calculations require sine and cosine computations (which requires calculation of a Taylor series expansion), logarithmic, and square root computations. Such computations necessitate relatively large processing capability and memory requirements. For example, such a conventional speech coder is defined in TIA/EIA Interim Standard IS-127, "Enhanced Variable Rate Codec, Speech Service Option 3 for Wideband Spread Spectrm Digital Systems. The defined speech codec consumes a relatively large amount of computational power in the platform for eighth-rate encoding and decoding.

In the embodiment described, an LUT is used to eliminate the need to perform the above calculations. Because $Y=F_x(X)$, the inverse transformation dictates that $X=F^{-1}(Y)$. As stated above, X can be any distribution. The LUT is advantageously based upon the cdf of a Gaussian random variable with mean of zero and variance of one, as depicted in FIG. 7. In a particular embodiment, Y is quantized into 256 levels between zero and one because Y is uniformly distributed between zero and one. A random number between zero and one is generated to yield the values of Y. The corresponding Gaussian random numbers, X, are calculated in advance in accordance with the inverse transformation equation and stored in the LUT. The LUT, which is addressed by the Y values, is used to map quantized Y values to X values.

In one embodiment the quantization of Y between zero and one into 256 levels uses an LUT whose size is reduced by half. As those of skill in the art would understand, the reduction by half in LUT size is possible because of the anti-symmetry of the cdf, $F_x(x)$, around $F_x(x)=0.5$. In other words, $F_x(m+x)=0.5-F_x(m-x)$, where m is the mean of $F_x(x)$, so $F^{-1}(y+0.5)=-F^{-1}(-y+0.5)$. In an alternate embodiment, the LUT size is not reduced by half, but instead the resolution is increased (i.e., the quantization error is reduced).

Thus, a novel and improved method and apparatus for eighth-rate random number generation for speech coders has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A speech coder, comprising:

a random number generator configured to generate values of a first random variable;

a storage medium coupled to the random number generator, the storage medium containing values of a second random variable, the second random variable comprising an inverse transform of a cumulative distribution function of the first random variable; and a codec coupled to the random number generator, the codec being configured to encode input silence frames with the values of the first and second random variables and to regenerate the silence frames with the values of the first and second random variables.

2. The speech coder of claim 1, wherein the encoder is configured to encode the input silence frames at 1 kbps.

3. The speech coder of claim 1, wherein the speech coder is an enhanced variable rate coder.

4. The speech coder of claim 1, wherein the first and second random variables are statistically independent from each other and comprise first and second Gaussian random variables having values that are uniformly distributed between zero and one.

5. The speech coder of claim 1, wherein the storage medium comprises a lookup table that is addressed by the values of the first random variable.

6. A method of encoding silence frames, comprising the steps of:

generating values of a first random variable;

storing values of a second random variable, the second random variable comprising an inverse transform of a cumulative distribution function of the first random variable; and encoding silence frames with the values of the first and second random variables; and regenerating the silence frames with the values of the first and second random variables.

7. The method of claim 6, wherein the encoding step is performed at a rate of 1 kbps.

8. The method of claim 6, wherein the first and second random variables are statistically independent from each other and comprise first and second Gaussian random variables having values that are uniformly distributed between zero and one.

9. The method of claim 6, wherein the storing step comprises storing the values of the second random variable in a lookup table that is addressed by the values of the first random variable.

10. A speech coder, comprising:

means for generating values of a first random variable;

means for storing values of a second random variable, the second random variable comprising an inverse transform of a cumulative distribution function of the first random variable; and means for encoding silence frames with the values of the first and second random variables; and means for regenerating the silence frames with the values of the first and second random variables.

11. The speech coder of claim 10, wherein the means for encoding is configured to encode the silence frames at 1 kbps.

12. The speech coder of claim 10, wherein the speech coder is an enhanced variable rate coder.

13. The speech coder of claim 10, wherein the first and second random variables are statistically independent from each other and comprise first and second Gaussian random variables having values that are uniformly distributed between zero and one.

14. The speech coder of claim 10, wherein the storage medium comprises a lookup table that is addressed by the values of the first random variable.

* * * * *

UNITED STATES PATENT AND TRADEMARK OFFICE

CERTIFICATE OF CORRECTION

PATENT NO. : 6,226,607 B1
DATED : May 1, 2001
INVENTOR(S) : Chienchang Chang and Tao Shen It is certified that error appears in the above-identified patent and that said Letters Patent is hereby corrected as shown below:

Title page,
Item [75], should read as follows:
-- Inventors: Chienchang Chang and Tao Shen --

Signed and Sealed this

Fifth Day of March, 2002

*Attest:*

*Attesting Officer*

JAMES E. ROGAN
*Director of the United States Patent and Trademark Office*